United States Patent [19]

Buglione

[11] 4,150,746

[45] Apr. 24, 1979

[54] TOOL BOX APPLIANCE

[76] Inventor: Victor A. Buglione, 106-16 75th St., Jamaica, N.Y. 11417

[21] Appl. No.: 843,636

[22] Filed: Oct. 19, 1977

[51] Int. Cl.[2] ..... B65D 85/20

[52] U.S. Cl. ..... 206/372; 206/378; 220/23; 312/DIG. 33

[58] Field of Search ..... 206/378, 372, 373, 349, 206/486, 379; 220/23; 312/DIG. 33

[56] References Cited

U.S. PATENT DOCUMENTS

| | | | |
|---|---|---|---|
| 1,916,984 | 7/1933 | Naken | 206/373 |
| 2,505,510 | 4/1950 | Vermillion | 206/372 |
| 2,522,218 | 9/1950 | Doniger | 206/375 |
| 2,572,706 | 10/1951 | Eichholz et al. | 206/373 |
| 2,673,783 | 3/1954 | Rahm et al. | 220/23 |
| 3,405,377 | 10/1968 | Pierce | 206/378 |
| 3,578,153 | 5/1971 | Olson | 220/23 |

*Primary Examiner*—William T. Dixson, Jr.
*Attorney, Agent, or Firm*—Ostrolenk, Faber, Gerb & Soffen

[57] ABSTRACT

A portable tool case having an openable cover is provided with a tool holder mounted to the cover. A gravity operated keeper rod is mounted to automatically fall into a blocking position to retain tools in the holder when the cover is closed.

10 Claims, 4 Drawing Figures

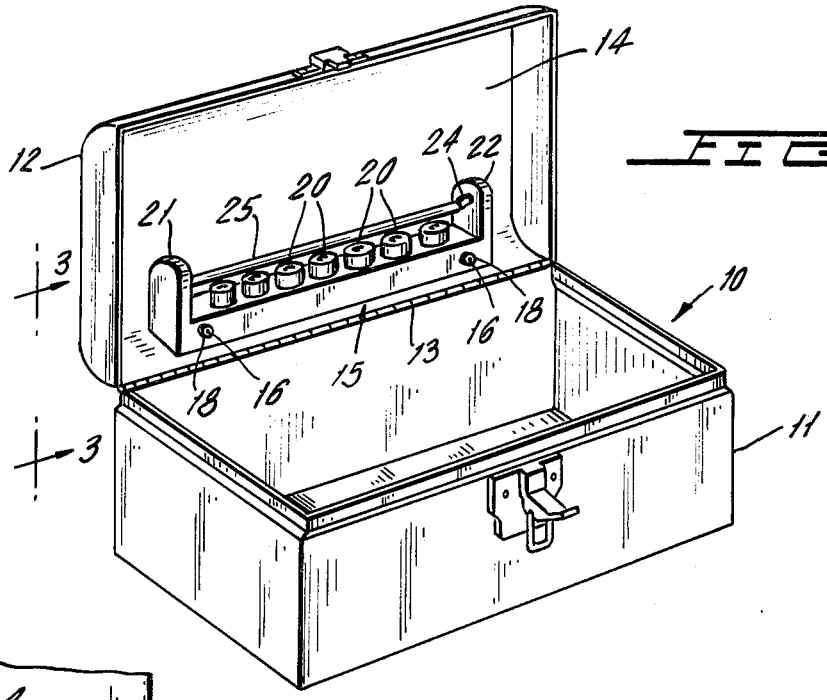
FIG. 1.
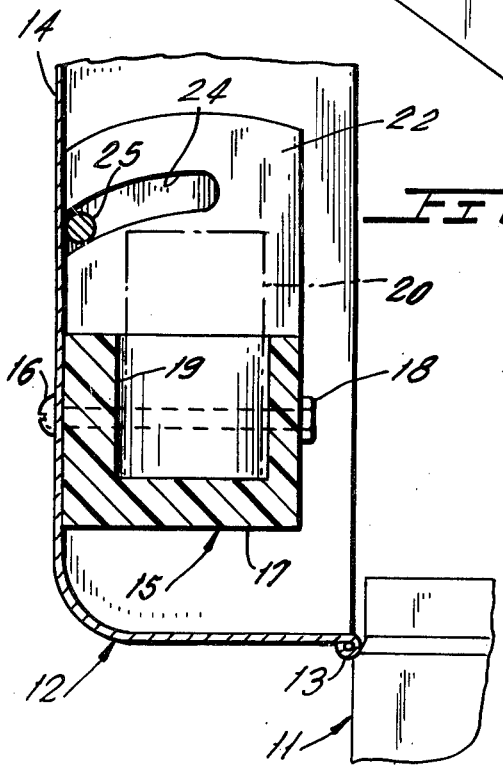
FIG. 3.
FIG. 4.
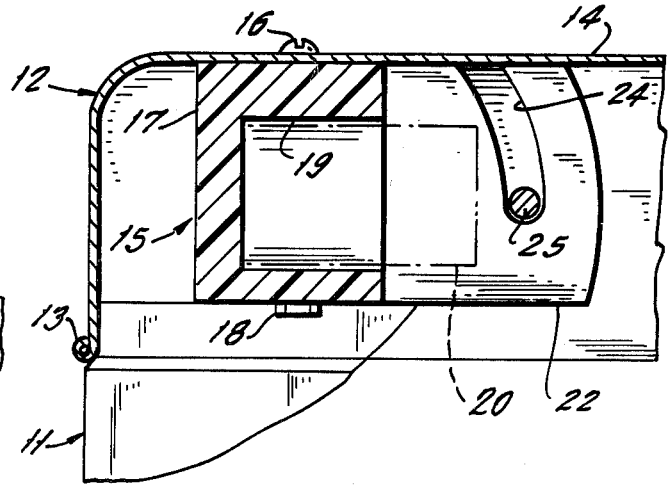
FIG. 2.
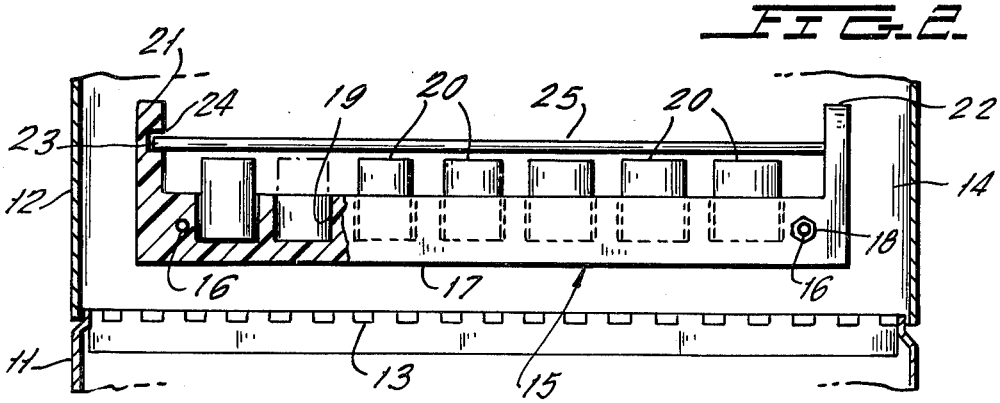

TOOL BOX APPLIANCE

This invention relates to portable tool cases in general and more particularly relates to novel keeper means for a tool holder mounted to the openable cover of the case.

Within the portable tool case of a typical mechanic there is a socket wrench set including a set of graduated sockets or heads. Unless these heads are kept in a special holder they are often lost in that the absence of one or more of these heads goes unnoticed. Further, unless the heads are arranged in a known order by a special tool holder, locating a particular size head is often time wasting.

Thus, the prior art provides tool holders for portable cases which in some instances are no more than small cases having openable covers. In other instances the holders are provided with tool retainers which consist of detachable elements that are often lost or consist of elements that must be manually operated to retaining positions. Some other prior art tool holders are provided with compartments in the form of trays which are mounted on complicated linkages so that the trays remain horizontal when the case is both open and closed. When these trays are horizontal tools are less likely to be spilled. When the case cover is open these trays move to a position which permits tools positioned below the trays to be removed from the case.

In order to overcome the above noted disadvantages of prior art tool holders, the instant invention provides a novel means for retaining tools within a tool holder mounted to the openable cover of a portable case. As will hereinafter be seen, this retaining means comprises a single bar which is automatically operated by gravity to a tool blocking position when the case cover is closed. This bar is also automatically gravity operated to a retracted position when the case cover is open thereby permitting convenient access to tools mounted in the holder.

Accordingly, a primary object of the instant invention is to provide novel inexpensive keeper means for retaining articles mounted in a holder carried by the openable cover of a case.

Another object is to provide keeper means of this type which automatically moves to its operative positions by gravity.

Still another object is to provide keeper means of this type which comprises a single bar having its ends disposed in slots which guide the bar for movement transverse to the axis thereof.

These objects as well as other objects of this invention shall become readily apparent after reading the following description of the accompanying drawings in which:

FIG. 1 is a perspective of a portable tool case having a tool holder and keeper means constructed in accordance with teachings of the instant invention.

FIG. 2 is a front elevation showing the tool holder and keeper means mounted to the case cover when the latter is in its open position.

FIGS. 3 and 4 are partially sectioned fragmentary side elevations of the case of FIG. 1 looking in the direction of arrows 3—3. In FIG. 3 the cover is shown in open position and in FIG. 4 the cover is closed.

Now referring to the Figures. Portable tool case 10 of FIG. 1 includes shallow box 11 having an open top which may be closed by cover 12. Hinge means 13 along one of the upper edges of box 11 pivotally connects cover 12 to box 11. In a manner well known to the art, hinge means 13 is constructed so as to limit opening movement of cover 12 to a position wherein the main section 14 thereof is generally vertical when case 10 rests on a horizontal surface.

Tool holder 15 is disposed within case 11, 12 by being mounted to the inner surface of main section 14 by screws 16, 16 which extend through clearance apertures in main section 14 and elongated body portion 17 to be received by fastening nuts 18, 18. With cover 12 open holder 15 is positioned so that cylindrical recesses spaced along the length of body 17 are open at their upper ends. Recesses 19 are graduated in diameter though of uniform depth to receive socket wrench heads 20 all of the same height but of different diameters with the diameter of a recess 19 for a particular socket being only slightly larger than the diameter of this socket.

Holder 15 is a one piece unit molded of plastic material and having transverse extensions or posts 21, 22 at opposite ends of body 17. The confronting surfaces of posts 21, 22 are provided with identical slanted or arcuate guide slots 23, 24, respectively, wherein opposite ends of cylindrical steel keeper rod 25 are disposed. Guide slots 23, 24 extend to an edge of the respective posts 21, 22 with these edges abutting the inner surface of main section 14 so that, in effect, both ends of guide slots 23, 24 are closed thereby retaining keeper bar 25.

With cover 12 open as in FIGS. 1 and 3, gravity biases bar 25 to its retracted position abutting the inner surface of main section 14. In this position bar 25 is disposed to one side of recesses 19 thereby permitting socket heads 20 to be readily removed from and inserted into recesses 19.

The closing of cover 12 repositions tool holder 15 so that recesses 19 are now open at the right side thereof when viewed in FIG. 4. Further, guide slots 23, 24 are repositioned so that under the influence of gravity, rod 25 moves transverse to the length thereof into the blocking position of FIG. 4. In this position rod 25 is approximately centered in front of recesses 19 and is so close to socket heads 20 that the latter are constrained to very limited movements relative to holder 15. Thus, for any normal carrying motion of case 10, and for most extraordinary motion that case 10 may be subjected to, keeper bar 25 will lock socket heads 20 so that they cannot fall from recesses 19.

When cover 12 is open, gravity acts on keeper bar 25 so that it moves automatically from its locking or retaining position of FIG. 4 to its retracted or inactive position of FIG. 3.

Although not shown, the front surface of the holder may be provided with indicia to indicate the size or other characteristic of the article in a particular recess. While the instant invention has been described in connection with socket heads of uniform height, it should now be apparent to those skilled in the art that if the socket heads are not of uniform height appropriate adjustments may be made to the depths of recesses 19, to the shape of rod 25 and/or to the guidance means therefore, all with a view toward retaining tools disposed within the holder recesses. It should also now be apparent to those skilled in the art that articles other than tools may be held in appropriately shaped recesses of another holder.

Further, retainers or equivalent devices may be provided at either or both ends of slots 23, 24 to hold rod 25. In such event manual operation will be required to effect holding engagement and disengagement between the retainers and rod 25. As an alternative, rod 25 will be constructed of ferro-magnetic material and permanent magnet means will be placed along slots 23, 24 to permit gravity operation of rod 25 to the blocking position of FIG. 4 where it will be retained by the magnet means. Manual operation will then be required to release rod 25 for movement to its retracted position of FIG. 3.

Although a preferred embodiment of this invention has been described, many variations and modifications will now be apparent to those skilled in the art, and it is therefore preferred that the instant invention be limited not by the specific disclosure herein, but only by the appending claims.

What is claimed is:

1. A case including a box having an open top, a cover for closing said top, means pivotally mounting said cover to said box for movement between a closed and an open position wherein a main section of said cover is respectively generally horizontal and generally vertical, a holder mounted to said cover in fixed position on the inside thereof, said holder having recess means for storage of articles therein, with said cover in said open position said recess means being operatively positioned for insertion and removal of articles through opening means at the top of said recess means, with said cover in said closed position said recess means being operatively positioned so that said opening means is at a side of said recess means, keeper means operatively connected to said cover for movement between first and second positions with respect to said cover means, said keeper means when in said first position permitting articles to be inserted and withdrawn from said recess means, said keeper means when in said second position blocking removal of articles from said recess means, means mounting said keeper means for automatic movement thereof to said second position under the influence of gravity when said cover is operated to said closed position.

2. A case as set forth in claim 1 in which the holder is secured directly to the cover and gravity is the sole means moving said keeper means to said second position upon moving said cover from said open to said closed position.

3. A case as set forth in claim 1 in which the means mounting the keeper means for automatic movement to said second position also permits automatic movement of said keeper means under the influence of gravity to said first position when said cover is operated to said open position.

4. A case as set forth in claim 1 in which the keeper means comprises a bar and the means mounting the keeper means for automatic movement to said second position comprises guide means wherein portions of said bar are disposed for movement of the bar transverse to its length.

5. A case as set forth in claim 4 in which the guide means comprises slots and said portions of said bar are at the ends thereof.

6. A case as set forth in claim 4 in which the means mounting the keeper means for automatic movement to said second position also permits automatic movement of said keeper means under the influence of gravity to said first position when said cover is operated to said open position.

7. A case as set forth in claim 5 in which the ends of the bar disposed in said slots are round to permit said ends to roll within said slots.

8. A case as set forth in claim 5 in which the first position of the keeper means is below the second position thereof when said cover is in said open position, and said second position is below said first position when said cover is in said closed position.

9. A case as set forth in claim 8 in which the means mounting the keeper means for automatic movement to said second position also permits automatic movement of said keeper means under the influence of gravity to said first position when said cover is operated to said open position.

10. A case as set forth in claim 9 in which said slots are parallel to each other, are inclined and are disposed at opposite ends of said holder.

* * * * *